US006884004B1

(12) United States Patent
Scales et al.

(10) Patent No.: US 6,884,004 B1
(45) Date of Patent: Apr. 26, 2005

(54) TENSILE REINFORCEMENT-TO RETAINING WALL MECHANICAL CONNECTION AND METHOD

(75) Inventors: John M. Scales, Norcross, GA (US); Thomas E. Evans, Jr., Atlanta, GA (US)

(73) Assignee: Geostar Corporation, Atlanta, GA (US)

( * ) Notice: Subject to any disclaimer, the term of this patent is extended or adjusted under 35 U.S.C. 154(b) by 0 days.

(21) Appl. No.: 10/341,179

(22) Filed: Jan. 13, 2003

(51) Int. Cl.[7] ..... E02D 17/00
(52) U.S. Cl. ..... 405/284; 405/262
(58) Field of Search ..... 405/262, 286, 405/284

(56) References Cited

U.S. PATENT DOCUMENTS

| | | | | | |
|---|---|---|---|---|---|
| 3,686,873 | A | | 8/1972 | Vidal | 61/39 |
| 4,324,508 | A | | 4/1982 | Hilfiker et al. | 405/284 |
| 4,616,959 | A | * | 10/1986 | Hilfiker | 405/286 |
| 4,661,023 | A | | 4/1987 | Hilfiker | 405/262 |
| 4,824,293 | A | | 4/1989 | Brown et al. | 405/284 |
| 4,914,876 | A | | 4/1990 | Forsberg | 52/169.4 |
| 5,028,172 | A | | 7/1991 | Wilson et al. | 405/286 |
| 5,044,834 | A | * | 9/1991 | Janopaul, Jr. | 405/284 |
| 5,064,313 | A | * | 11/1991 | Risi et al. | 405/284 |
| 5,091,247 | A | | 2/1992 | Willibey et al. | 428/255 |
| 5,131,791 | A | | 7/1992 | Kitziller | 405/286 |
| 5,145,288 | A | | 9/1992 | Borcherdt | 405/284 |
| 5,277,520 | A | | 1/1994 | Travis | 405/128 |
| 5,417,523 | A | | 5/1995 | Scales | 405/284 |
| 5,419,092 | A | | 5/1995 | Jaecklin | 52/562 |
| 5,607,262 | A | * | 3/1997 | Martin | 405/284 |
| 5,975,809 | A | | 11/1999 | Taylor et al. | 405/262 |
| 6,193,445 | B1 | | 2/2001 | Scales | 405/284 |
| 6,224,295 | B1 | | 5/2001 | Price et al. | 405/262 |
| 6,443,663 | B1 | | 9/2002 | Scales et al. | 405/262 |
| 6,447,211 | B1 | * | 9/2002 | Scales et al. | 405/262 |
| 6,457,911 | B1 | * | 10/2002 | Scales et al. | 405/262 |
| 6,536,994 | B1 | * | 3/2003 | Race | 405/262 |

OTHER PUBLICATIONS

Geogrid Properties and Test Methods, 3rd Ed.; Chap. 1 Overview of Geogrids, pp. 37–39; Chap. 2 Designing with Geotextiles, pp. 40–42; Chap. 3 Designing with Geogrids; pp. 328–351; Koerner, Robert M.; Prentice–Hall, Inc., Englewood Cliffs, NJ 07632.

* cited by examiner

*Primary Examiner*—Jong-Suk (James) Lee
*Assistant Examiner*—Lisa M. Saldano
(74) *Attorney, Agent, or Firm*—Baker, Donelson, Bearman, Caldwell & Berkowitz

(57) ABSTRACT

An tensile reinforcement-to retaining wall connection for a retaining wall (10) having stacked tiers (14, 16) of blocks (12) having channels (52, 54) in opposing surfaces (48, 50), which channels (54, 56) in adjacent tiers (14, 16) align to define a receiving conduit (18) between the adjacent tiers. An isolator sheet (20) overlies the channels (52) in the blocks (12) of the lower tier (14) at selected vertical intervals in the wall (10). A tensile reinforcement sheet (28) partially overlapped (26) defines a pocket (24) that receives a connector bar (22), which sit on the isolator sheet (20) in the receiving conduit (18). A portion of the tensile reinforcement sheet (28) extends from the wall (10) for receiving backfill to mechanically secure the wall to the backfill. The isolator sheet (20) protectingly reduces abrasion of the tensile reinforcement sheet (28) in the receiving conduit (18). A method of connecting a tensile reinforcement to a retaining wall with reduced abrasion is disclosed.

4 Claims, 4 Drawing Sheets

TENSILE REINFORCEMENT-TO RETAINING WALL MECHANICAL CONNECTION AND METHOD

TECHNICAL FIELD

The present invention relates to mechanical connections of tensile reinforcement-to-retaining wall blocks. More particularly, the present invention relates to mechanically connected tensile reinforcement-to-retaining wall blocks having reduced abrasion of laterally extending tensile reinforcement sheets at the retaining wall block connection.

BACKGROUND OF THE INVENTION

Mechanically stabilized earth retaining walls are construction devices used to reinforce earthen slopes, particularly where changes in elevations occur rapidly. For example, parking lots and building sites have leveled subgrade or built-up above grade portions and typically with steeply rising embankments. These embankments must be secured, such as by retaining walls, against collapse or failure to protect persons and property from possible injury or damage caused by the slippage or sliding of the earthen slope.

Many designs for earth retaining walls exist today. Wall designs must account for lateral earth and water pressures, the weight of the wall, temperature and shrinkage effects, and earthquake loads. The design type known as mechanically stabilized earth retaining walls employ either metallic or polymeric tensile reinforcements in the soil mass. The tensile reinforcements extend laterally of the wall formed of a plurality of modular precast concrete members or blocks stacked together. The tensile reinforcements connect the soil mass to the blocks that define the wall. The blocks create a visual vertical facing for the reinforced soil mass.

The metallic tensile reinforcements typically used are non-extensible steel straps or meshes. The straps are either smooth or have transverse ribs. The meshes have longitudinal wires which connect to transversely aligned wires thereby forming a mesh like matrix. The modular precast concrete members may be in the form of blocks or panels that stack on top of each other to create the vertical facing of the wall.

The extruded polymeric tensile reinforcements typically used are-elongated lattice-like structures often referred to as grids. The grids have elongated ribs which connect to transversely aligned bars thereby forming elongated apertures between the ribs. Various connection methods are used to interlock the blocks or panels of the wall with the tensile reinforcements. One known type of retaining wall has precast concrete panels with steel yokes extending outwardly from the back side. The yokes receive nuts and bolts or pins. The edge portions of the tensile reinforcement straps or mesh are secured to the yokes by the bolts or pins. The straps or mesh extend laterally from the panels and are covered with backfill. The strength of the tensile reinforcement strap or mesh-to-wall connection is generated by the mechanical connection between the steel yoke and bolt or pin assembly to the tensile reinforcement strap or mesh. Another type of retaining wall has blocks with bores extending inwardly within the top and bottom surfaces. The bores receive dowels or pins. Edge portions of the polymeric tensile reinforcement grids or steel mesh are secured by the dowel pins. The tensile reinforcement extends laterally from the blocks and is covered with back fill. Subsequent tiers are constructed by placing blocks, with aggregate infill, in the wall. The strength of the tensile reinforcement grid or mesh-to-wall connection is generated by friction between the upper and lower block surfaces and the tensile reinforcement grid or mesh and the linkage between the aggregate trapped by the wall and the apertures of the tensile reinforcement grid or mesh. The magnitude of these two contributing factors varies with the workmanship of the wall, normal stresses applied by the weight of the wall above the connection, and by the quality and size of the aggregate.

Other connection devices are known. For example, my U.S. Pat. No. 5,417,523 describes a connector bar with spaced-apart keys that engage apertures in the tensile reinforcement grid that extends laterally from the wall. The connector bars are received in channels defined in the upper and lower surfaces of the blocks.

The specifications for earth retaining walls are based upon the strength of the interlocking components and the is load created by the backfill. Once the desired wall height and type of ground conditions are known, the strength of the tensile reinforcement, the number of tensile reinforcement, the vertical spacing between adjacent tensile reinforcement, and lateral positioning of the tensile reinforcement is determined, dependent upon the load capacity of the interlocking components.

Heretofore, construction of such mechanically stabilized earth retaining walls has been limited to the use of significantly expensive high strength tensile reinforcement. This is due in part to the efficiency of the tensile reinforcement-to-retaining wall connection. High strength steel straps and meshed are effectively non-extensible therefore they reach their peak tensile strength with a minimum of elongation and provide excellent tensile reinforcement-to-retaining wall connection. However, they are expensive and subject to corrosion. To reduce costs, tensile reinforcements other than steel straps or mesh have been developed for use with mechanically stabilized earth retaining walls. These other tensile reinforcements include extruded, woven, or knitted grids with large or small apertures, as well as woven or knitted textile sheets. These other tensile reinforcements are significantly less expensive than tensile reinforcement steel straps and mesh. However, they are extensible and therefore elongate 8 percent to 20 percent prior to reaching their peak tensile strength.

While these extruded, woven or knitted tensile reinforcement grids or sheets have been used to mechanically stabilize walls to backfill, there is a drawback. The lateral loading on the extending tensile reinforcement causes a portion of the tensile reinforcement to elongate and to move on a bearing surface of the block. The movement wears and abrades the tensile reinforcement, and leads to premature connection failure. To overcome this, designers generally "over-engineer" the strength of the tensile reinforcement. This leads to the use of tensile reinforcement that is heavier, more expensive, less readily available and more cumbersome to handle, in order that the abrasion-damaged tensile reinforcement meets the minimum design strength of the tensile reinforcement-to-wall connection. Extensive abrasion can lead to failure of the tensile reinforcement and collapse of the wall.

Accordingly, there is a need in the art for earth retaining walls with positive tensile reinforcement-to-retaining wall connections that minimize abrasion damage to the portion of the tensile reinforcement in direct contact with the bearing surfaces within the connection. It is to such that the present invention is directed.

BRIEF SUMMARY OF THE INVENTION

The present invention meets the need in the art by providing a tensile reinforcement-to-retaining wall connection for a retaining wall comprising at least two tiers of blocks placed side by side and a tensile reinforcement sheet connected to the retaining wall by a bearing surface and extending therefrom into backfill material, the connection thereof further comprising an isolator surface disposed between the tensile reinforcement sheet and the bearing surface and substantially co-extensive with a width of the tensile reinforcement sheet in the connection, whereby abrasion of the tensile reinforcement sheet by the bearing surface is reduced. Methods of constructing a tensile reinforcement sheet-to-retaining wall connection for a retaining wall are disclosed and particularly set forth in the claims below.

DETAILED DESCRIPTION

Figure 1:
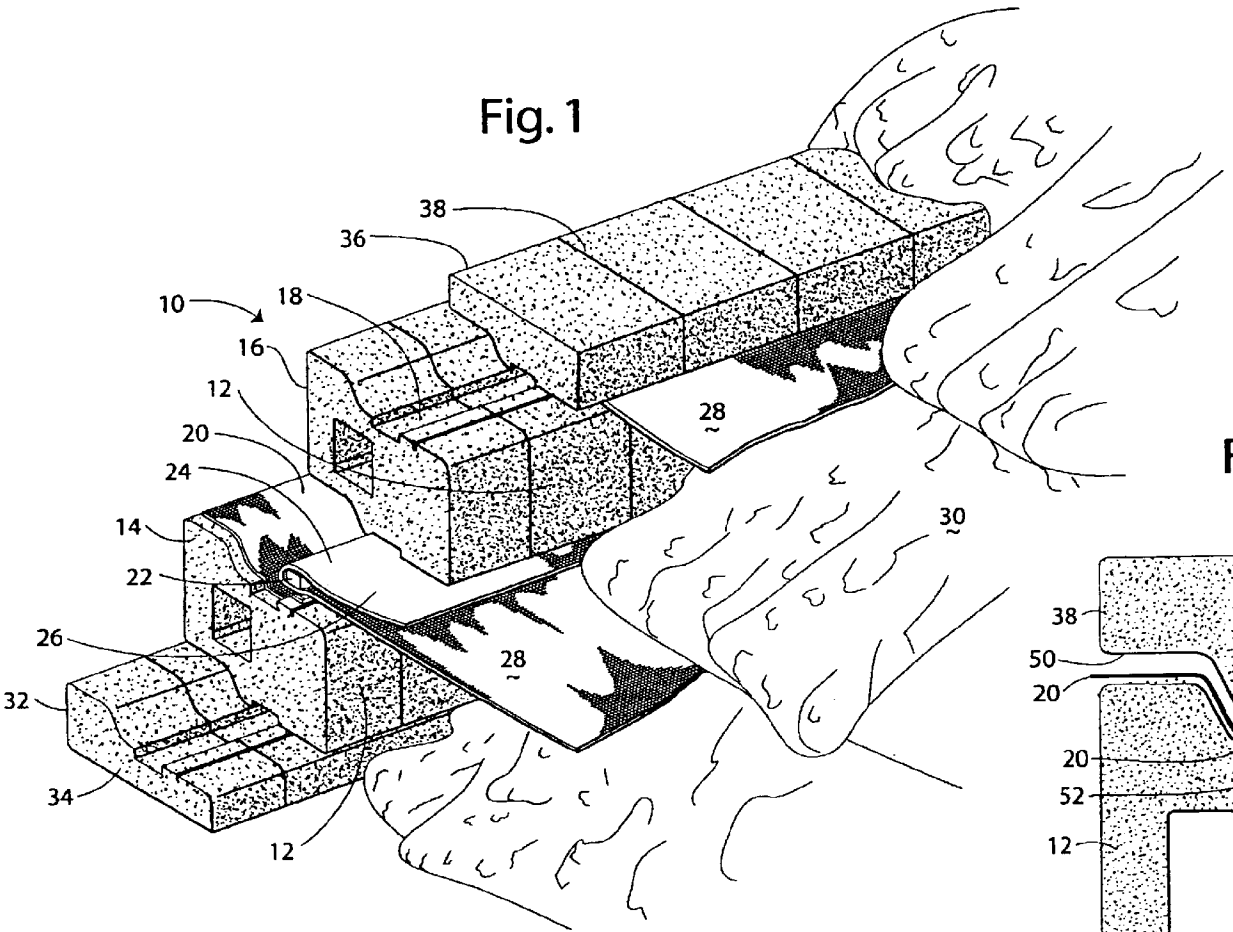
FIG. 1 illustrates a perspective cut-away view of a portion of an earth retaining wall according to the present invention.

Referring now in more detail to the drawings in which like parts have like identifiers, FIG. 1 is a perspective cut-away view of a portion of a mechanically stabilized earth retaining wall 10 with a connection generally between a tensile reinforcement sheet and the wall, according to the present invention. The wall 10 comprises a plurality of blocks 12 placed in side by side relation to define adjacent tiers 14, 16. The blocks 12 (described in more detail below) define a receiving conduit 18 that receives an isolator sheet 20 and a connector bar 22 in a pocket 24 defined by an overlapped end portion 26 of a tensile reinforcement sheet 28. The isolator sheet 20 separates the wrapped tensile reinforcement sheet 28 from contact with the receiving conduit 18 for reducing abrasion on the loaded tensile reinforcement sheet. The tensile reinforcement sheet 28 extends laterally of the wall 10 at selected vertical intervals and horizontal spacing. The tensile reinforcement sheet 28 receives backfill material 30. The backfill material 30 engages the tensile is reinforcement sheet 28 to interlock the blocks 12 in the wall 10 to the backfill material 30. The connector bar 22 communicates the loading on the tensile reinforcement sheet 28 to bearing surfaces of the receiving conduit 18 and thus to the wall 10. The bearing surfaces are portions of the blocks 12 that cooperatively define the receiving conduit 18, as discussed below.

The wall 10 comprises at least two tiers 14,16 of the blocks 12 (as illustrated) from which the tensile reinforcement sheets 18 extend laterally. The blocks 12 in each tier 14, 16 are placed side-by-side to form the elongated retaining wall 10. Soil, gravel, or other backfill material 30 placed on an interior side of the wall 10 covers and loads the tensile reinforcement sheet 28.

Figure 2:
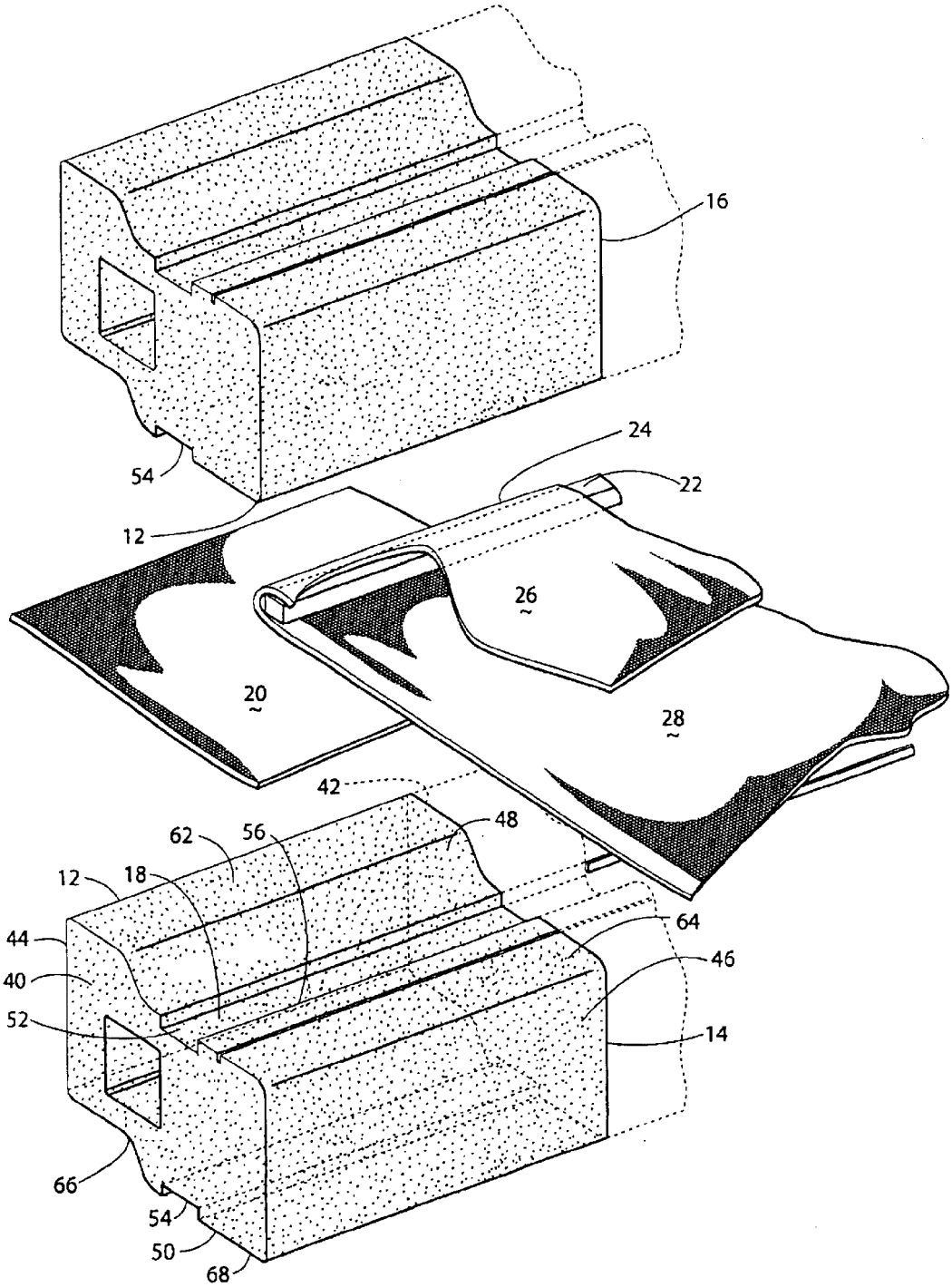
FIG. 2 illustrates a detailed perspective view of adjacent tiers of blocks in the earth retaining wall shown in FIG. 1.

With reference to the perspective view in FIG. 2, each of the blocks 12 is defined by opposing side walls 40, 42, opposing front face 44 and back face 46, and opposing top and bottom sides 48, 50. The block 12 defines an upper channel 52 and lower channel 54 extending between the opposing sides 40, 42 in the top and bottom sides 48, 50, respectively. In the illustrated embodiment, the channels 52, 54 each defines a rectangular shape in cross-sectional view. In an alternate embodiment, the channels 52, 54 define a triangular shape in cross-sectional view. The channels 52, 54 are aligned, whereby the upper channel 52 in the blocks 12 of the first tier 14 align with the lower channel 54 in the blocks of the second tier 16, to define the receiving conduit 18. The inward wall of the channel 52 defines a bearing surface 56. In some prior art tensile reinforcement-to-retaining wall connections, the bearing surface 56 causes wear and abrasion on the tensile reinforcement sheet 28 disposed within the receiving conduit 18 when a load applied to the laterally extending tensile reinforcement 28 is communicated to the connector bar 22 and the bearing surface 56 of the receiving conduit 18, which the present invention addresses.

The isolator sheet 20 is made of a substantially non-abrasive material, a material less abrasive than the bearing surfaces of the block 12, or a bonded coating such as a laytex material, having a less abrasive surface than the bearing surface of the block 12. The isolator sheet 20 is preferable a plastic sheet or a woven, knitted or non-woven fabric sheet. The width of the isolater sheet 20 is substantially the width of the block 12 between the opposing front and back faces 44, 46. The isolator sheet 20 occupies the upper channel 52 in the blocks 12 of tiers from which the tensile reinforcement sheet 28 extends laterally.

As best illustrated in FIG. 2, the connector bar 22 occupies the pocket 24 defined by overlapping the end portion 26 of the tensile reinforcement sheet 28. The wrapped connector bar 22, with the tensile reinforcement sheet 28, occupies the channel 52 in the blocks of the tiers from which the tensile reinforcement sheet extends laterally of the wall 10. The blocks 12 in the upper tier 16 align with and seat on the blocks in the lower tier 14. The aligned channels 52, 54 of the blocks in the tiers 14, 16 thereby define the receiving conduit 18. The isolator sheet 20 separates, the tensile reinforcement sheet 28 from wearing contact on the bearing surface 56.

Figure 3:
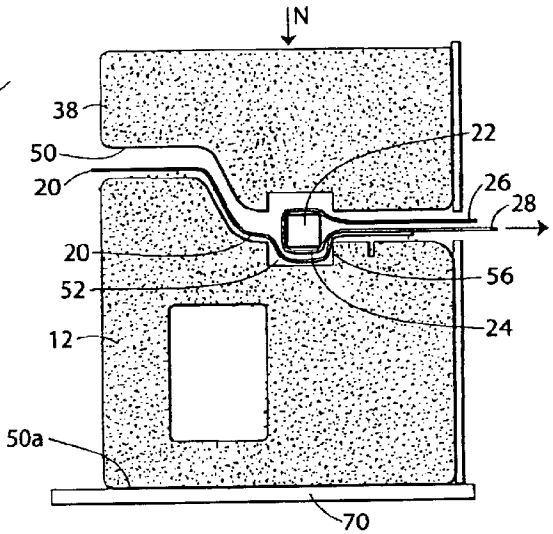
FIG. 3 is a cross-sectional schematic illustration of a testing apparatus for evaluating tensile strength of tensile reinforcement sheets using the present invention.

FIG. 3 is a cross-sectional, exploded schematic illustration of a pull-out testing box 70 for evaluating tensile strength of tensile reinforcement sheets using the present invention. The block 12 is modified by eliminating the matingly engageable portions of the bottom side 50*a* to provide a flat surface to seat on a base of the pull-out box 70, while the back face 46 bears against a side wall of the pull-out box. The isolator sheet 20 sits on the top side 48 and in the channel 52. The wrapped connector bar 22 sits on the isolator sheet 20 and the extended portion of the tensile reinforcement sheet 28 connects outwardly to a loading apparatus. The loading apparatus places an increasing load on the tensile reinforcement sheet 28 during testing to determine the tensile strength and/or pull-out values for tensile reinforcement-to-retaining wall connection 11 constructed with the blocks 12. The cap block 38 sits on the bottom block to enclose the connector bar 22 and tensile reinforcement sheet 28 within the receiving conduit 18. The cap block 38 bears against a portion of the side wall of the pull-out box 70. A compressive force applied- to the cap block 38 provides a normal loading N on the connector 22, the isolator sheet 20, and the tensile reinforcement sheet 28 held in the receiving conduit 18.

The connection strength testing was conducted according to ASTM D 6638 standards. The test specimen of the tensile reinforcement sheet 28 was 8 inches wide. The tensile reinforcement sheet was a GEOMAX 400 textile sheet available from Geostar Corporation, Atlanta, Ga. The normal stress was 11.4 pounds per square inch, which corresponds to an equivalent normal load of 1643 pounds per square foot. This normal load was approximately that provided by 15 vertical stacked blocks of the type subjected to the test. With one foot heights for the blocks, the test was equivalent to a 15 foot wall 10.

Test 1A did not include the isolator sheet 20, but provided bearing contact between the tensile reinforcement sheet 28 and the channel 52. Test 1B and 1C included the isolator sheet 20 in the form of a 4 ounce per square yard nonwoven fabric sheet.

TABLE 1

CONNECTION STRENGTH TESTING

| TEST | 0.75 Inch Strength (lb/ft) | Peak Strength (lb/ft) |
|---|---|---|
| 1A | 1626 | 2222 |
| 1B | 1881 | 3225 |
| 1C | 1887 | 3591 |

Figure 4:
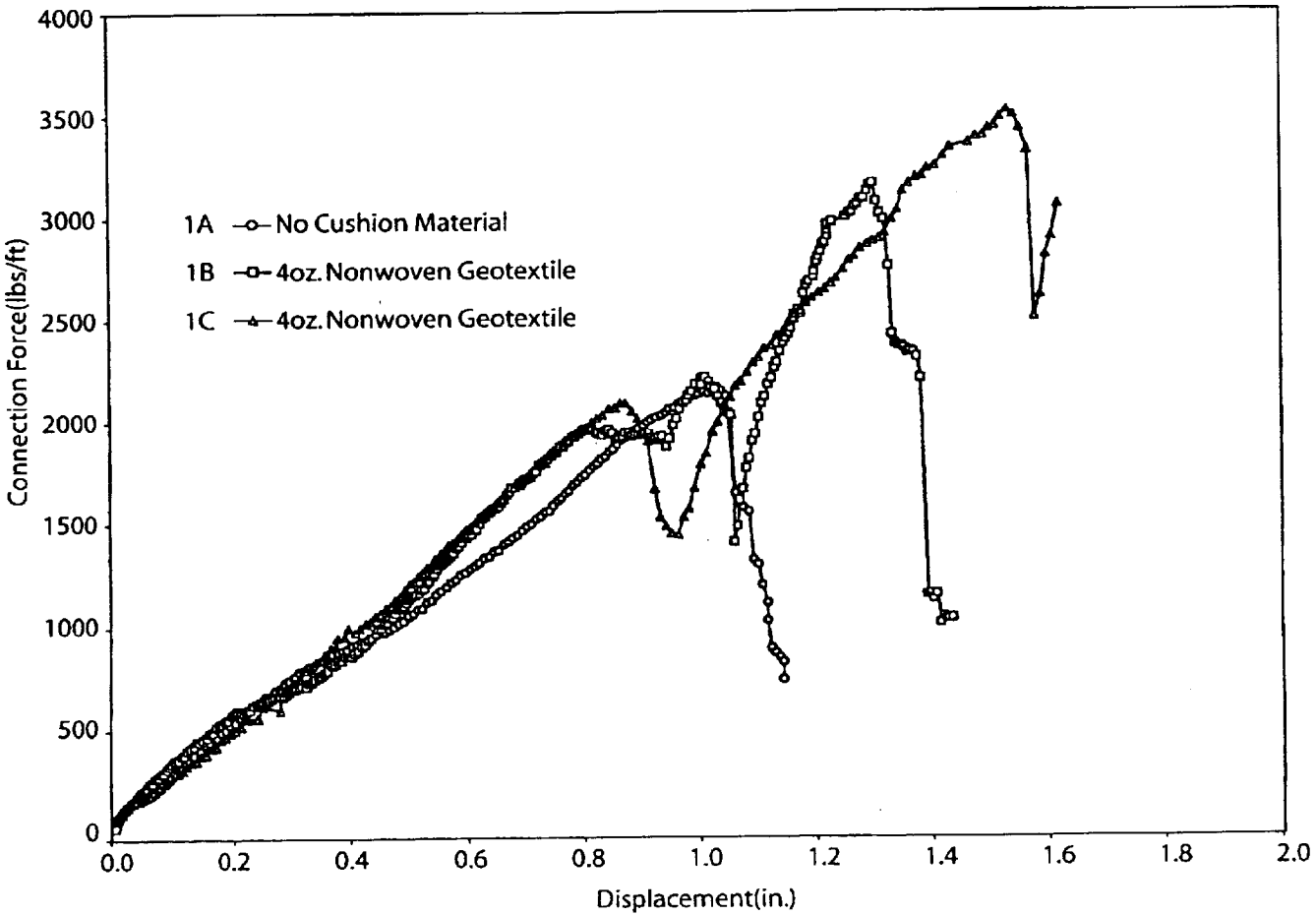
FIG. 4 is a graph showing comparisons of tests of tensile reinforcement sheets.

FIG. 4 is a graph of measured connection force versus displacement for the tests reported in Table 1 above. Based on these tests, the same tensile reinforcement sheets separated from bearing surfaces by the isolator sheet developed significantly higher peak connection strength. The average increase was approximately 53% for the particular tensile reinforcement tested.

During use of the tensile reinforcement-to-retaining wall connection, the lateral earth pressures from the backfill 30 cause the tensile reinforcement sheet 28 to elongate. This movement induces relative movement between the tensile reinforcement sheet 28 and the isolator sheet 20. The bearing surface 56 contacts the isolator sheet 20. The isolator sheet 20 however does not abrade or wear the tensile reinforcement sheet 28 to the extent observed in the prior art mechanically tensile reinforcement-to wall connections where the tensile reinforcement sheet 28 is in contact with the bearing surface 56. In particular, the isolator sheet 20, is not under load and is substantially stationary. The loaded tensile reinforcement sheet 28 and the isolator sheet 20 experience relative movement, but with significantly less abrasion and wear on the tensile reinforcement sheet. Consequently, tensile reinforcement sheets 28 can develop greater connection strength.

Figure 5:
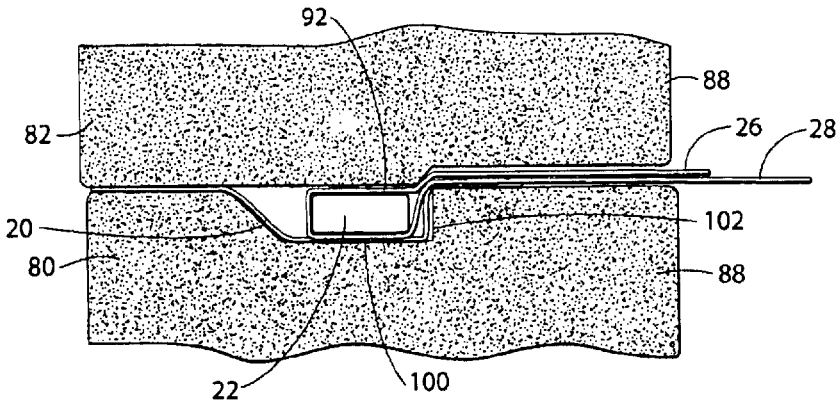
FIG. 5 illustrates in cross-sectional view an alternate embodiment of the present invention.

FIG. 5 illustrates a cross-sectional cut-away view of adjacent tiers 80, 82 of a tensile reinforcement-to-retaining wall connection with blocks 88, which cooperatively define a receiving conduit 92 therebetween. In the illustrated embodiment, a top surface of the block 88 defines a channel 100 with inwardly sloping sides and a bearing surface 102. A bottom surface of the block 88 defines a downwardly projecting rib 103. The non-abrasive isolator sheet 20 overlies the top surface of the block 88 and is disposed in the channel 100. The tensile reinforcement 28 overlies the non-abrasive isolator layer 20 and is disposed in the channel 100 and extends laterally from the blocks 12 to receive backfill material 30. The connector bar 22 sits on the tensile reinforcement 28 and is disposed in the channel 100. The blocks 88 in tier 82 sit over the blocks 88 in tier 80 so that the bottom side structure aligns substantially with the top side structure and define the receiving conduit 92 for the connector bar 22, the tensile reinforcement 28 and the non-abrasive isolator sheet 20. In an alternate embodiment (not illustrated), the top surface of the block 88 defines a channel 100 with vertical sides that cooperatively with the downwardly projecting rib defines the receiving conduit 92.

Figure 6:
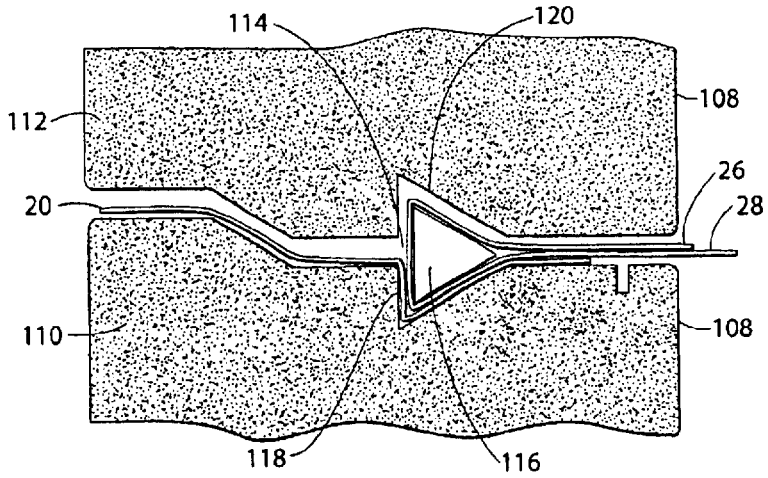
FIG. 6 illustrates in cross-sectional view a second alternate embodiment of the present invention.

FIG. 6 illustrates in cross-sectional view adjacent tiers 110, 112 in a second alternate embodiment of the present invention. The tiers 110, 112 form with blocks 108 that cooperatively define a receiving conduit 114 which receives the connector bar 116 in the overlapped portion of the tensile reinforcement sheet 28 on the isolator sheet 20. The blocks 108 define a top surface of the block 108 and an opposing bottom surface, in which the structural features thereof define triangular recesses 118, 120 extending between opposing sides of the block. The receiving conduit 114 receives the wrapped connector bar 116 that is triangular in cross-section. The isolator sheet 20 protectingly cushions the tensile reinforcement sheet 28 and reduces abrasion from the bearing face in the channel 118.

Figure 7:
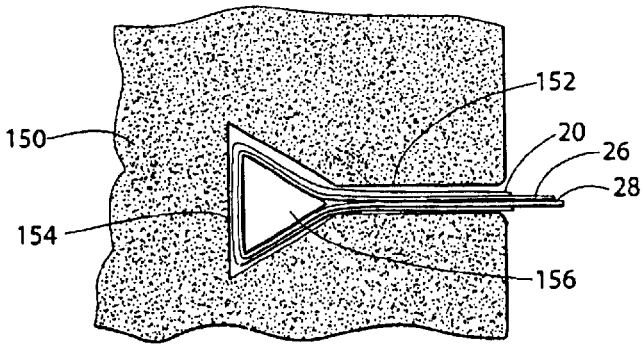
FIG. 7 is a side elevational view of an alternate embodiment of a block using the tensile reinforcement-to-retaining wall connection of the present invention.

FIG. 7 illustrates in cross-sectional view a block 150. The block 150 defines a receiving conduit 154 extending between opposing sides of the block. A slot 152 extends from the receiving conduit 154 to a back face of the block. The receiving conduit 154 receives the non-abrasive isolator sheet 20 through the slot 152. The receiving conduit 154 also receives a connector bar 156 that in the illustrated embodiment is triangular in cross-section wrapped in, the overlapped portion of the tensile reinforcement 28 within a pocket formed by the non-abrasive isolator sheet 20 and the tensile reinforcement 28. The tensile reinforcement 28 extends through the slot into backfill behind the wall formed with a plurality of the blocks 150. In the illustrated embodiment, the receiving conduit 154 is substantially triangular in cross-section, whereby the connector bar and the conduit are conformingly shaped. The backfill loads the tensile reinforcement 28 which secures the connector bar 156 against bearing surfaces in the receiving conduit 154. The isolator sheet 20 reduces abrasion on the tensile reinforcement 28.

While this invention has been described in detail with particular reference to the preferred embodiments thereof, the principles and modes of operation of the present invention have been described in the foregoing specification. The invention is not to be construed as limited to the particular forms disclosed because these are regarded as illustrative rather than restrictive. Moreover, modifications, variations and changes may be made by those skilled in the art without departure from the spirit and scope of the invention as described by the following claims.

What is claimed is:

1. A method of constructing a tensile reinforcement sheet-to-retaining wall connection, the retaining wall assembled from at least two tiers of blocks placed side by side and a tensile reinforcement sheet connected to the retaining wall by a bearing surface and extending therefrom into backfill material, comprising the steps of:

(a) positioning a plurality of blocks in side by side relation to define a first tier of a length of a wall, each of the blocks defining channels in vertically-spaced opposing surfaces;

(b) placing an isolator sheet having a longitudinally extending length in the vertically upper channel of at least one of the blocks in the first tier;

(c) positioning a connector bar overwrapped with a portion of a tensile reinforcement sheet within the channel with a portion of the tensile reinforcement sheet extending therefrom, the tensile reinforcement sheet substantially co-extensive with the longitudinal extents of the isolator sheet;

(d) positioning blocks in side by side relation on the first tier to define a second tier of the wall, the vertically lower channels of the blocks in the second tier aligning with the vertically upper channels of the first tier, said channels defining lateral bearing surfaces to hold the overwrapped connector bar within the wall;

(e) covering the portion of the tensile reinforcement sheet lateral of the wall with backfill to mechanically engage the wall to the backfill, whereby the isolator sheet protectingly reduces abrasion of the loaded tensile reinforcement sheet by the bearing surfaces.

2. A method of constructing a tensile reinforcement sheet-to-retaining wall connection, the retaining wall assembled from at least two tiers of blocks placed side by side and a tensile reinforcement sheet connected to the retaining wall by a bearing surface and extending therefrom into backfill material, comprising the steps of:

(a) positioning a plurality of blocks in side to side relation to define a first tier of a blocks, each of the blocks having a top side with a structural feature of a first character;

(b) placing an isolator sheet having a longitudinally extending length overlying the structural feature of the first character in the blocks in the first tier;

(c) positioning a connector bar overwrapped with a portion of a tensile reinforcement sheet within the structural feature of the first character in the blocks of the first tier with a portion of the tensile reinforcement sheet extending laterally thereof, the tensile reinforcement sheet substantially co-extensive with the longitudinal extents of the isolator sheet;

(d) positioning blocks in side by side relation on the first tier to define a second tier of blocks, each of the blocks of the second tier having a bottom side with a structural feature of a second character, the structural feature of the second character aligning with the structural feature of the first character of the first tier, said alignment defining receiving conduits with lateral bearing surfaces to hold the overwrapped connector bar within the blocks;

(e) covering the portion of the tensile reinforcement sheet lateral of the blocks with backfill to mechanically engage the blocks to the backfill, whereby the isolator sheet protectingly reduces abrasion of the loaded tensile reinforcement sheet by the bearing surfaces.

3. A method of constructing a tensile reinforcement sheet-to-retaining wall connection, the retaining wall assembled from at least two tiers of blocks placed side by side and a tensile reinforcement sheet connected to the retaining wall by a bearing surface and extending therefrom into backfill material, comprising the steps of:

(a) positioning a plurality of blocks in side to side relation to define a first tier of a blocks, each of the blocks having a top side with a structural feature of a first character;

(b) placing an isolator sheet having a longitudinally extending length overlying the structural feature of the first character in the blocks in the first tier;

(c) placing a portion of a tensile reinforcement sheet overlying the isolator sheet and the structural feature of the first character in the blocks in the first tier with a portion of the tensile reinforcement sheet extending laterally thereof, the tensile reinforcement sheet substantially co-extensive with the longitudinal extents of the isolator sheet;

(d) positioning a connector bar within the structural feature of the first character in the blocks in the first tier;

(e) positioning blocks in side by side relation on the first tier to define a second tier of blocks, each of the blocks of the second tier having a bottom side with a structural feature of a second character, the structural feature of the second character aligning with the structural feature of the first character of the first tier, said alignment defining receiving conduits with lateral bearing surfaces to hold the connector bar within the blocks; and (f) covering the portion of the tensile reinforcement sheet lateral of the blocks with backfill to mechanically engage the blocks to the backfill, whereby the isolator sheet protectingly reduces abrasion of the loaded tensile reinforcement sheet by the bearing surfaces.

4. A method of constructing a tensile reinforcement sheet-to-retaining wall connection, the retaining wall assembled from at least two tiers of blocks placed side by side and a tensile reinforcement sheet connected to the retaining wall by a bearing surface and extending therefrom into backfill material, comprising the steps of:

(a) positioning a plurality of blocks in side to side relation to define a tier of blocks, each of the blocks having a back side with a structural feature of a character that defines a receiving conduit;

(b) placing an isolator sheet having a longitudinally extending length disposed in the receiving conduit in the blocks in the tier;

(d) positioning a connector bar overwrapped with a portion of a tensile reinforcement sheet within the receiving conduit with a portion of the tensile reinforcement sheet extending laterally thereof, the tensile reinforcement sheet substantially co-extensive with the longitudinal extents of the isolator sheet; and (e) covering the portion of the tensile reinforcement sheet lateral of the blocks with backfill to mechanically engage the blocks to the backfill, whereby the isolator sheet protectingly reduces abrasion of the loaded tensile reinforcement sheet by the bearing surfaces.

* * * * *